United States Patent [19]

Graham

[11] 3,982,662

[45] Sept. 28, 1976

[54] ARTICLE ESCAPEMENT MECHANISM FOR CASE PACKING MACHINES

[75] Inventor: Robert H. Graham, Spokane, Wash.

[73] Assignee: R. A. Pearson Company, Spokane, Wash.

[22] Filed: Nov. 17, 1975

[21] Appl. No.: 632,501

[52] U.S. Cl. ..... 221/296; 221/298

[51] Int. Cl.[2] ..... G07F 11/16

[58] Field of Search ..... 221/93, 227, 293, 296, 221/298; 53/247, 248, 61; 214/83.22, 307

[56] References Cited

UNITED STATES PATENTS 3,926,336 12/1975 Graham et al. ..... 221/296

*Primary Examiner*—Stanley H. Tollberg

*Attorney, Agent, or Firm*—Wells, St. John & Roberts

[57] ABSTRACT

An escapement mechanism for successively releasing rectangular groups of articles from an upright stack. The articles are of the type having reduced top ends and enlarged bottom ends. The articles are held within an upright hopper that guides the stack gravitationally toward the escapement mechanism. Successive groups of articles are engaged by a first stop mechanism at a first elevation and are lowered thereby to a second elevation. A retractable support is located at the second elevation to receive and support the successive groups of articles. While articles are resting upon the retractable support, the stop means is moved upwardly again to engage the bottom sides of the next successive group of articles and lift them upwardly from engagement with the top ends of the article group presently supported on the retractable support. Once to successive groups become disengaged from one another, the support is retracted to allow one group to fall gravitationally to a transfer mechanism. The stop mechanism is then again operated to gradually lower the next successive group of articles toward engagement on the retractable support.

8 Claims, 8 Drawing Figures

FIG. 5
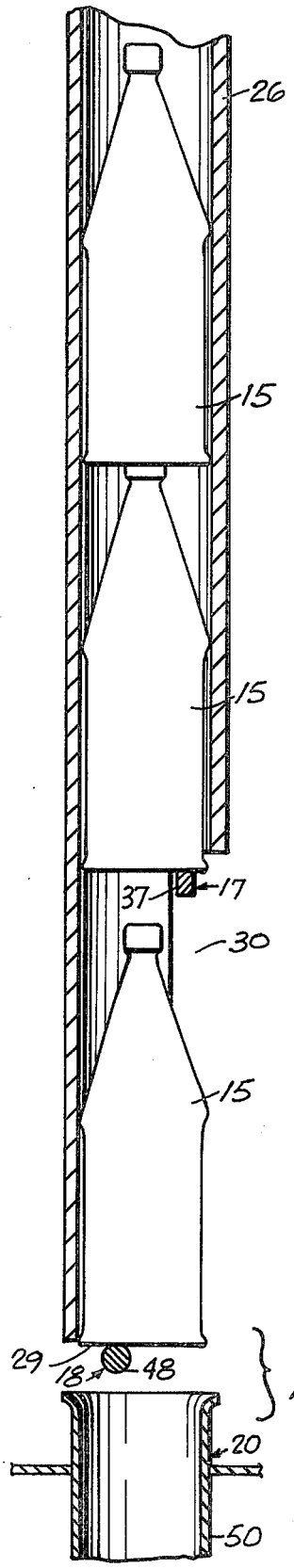
FIG. 6
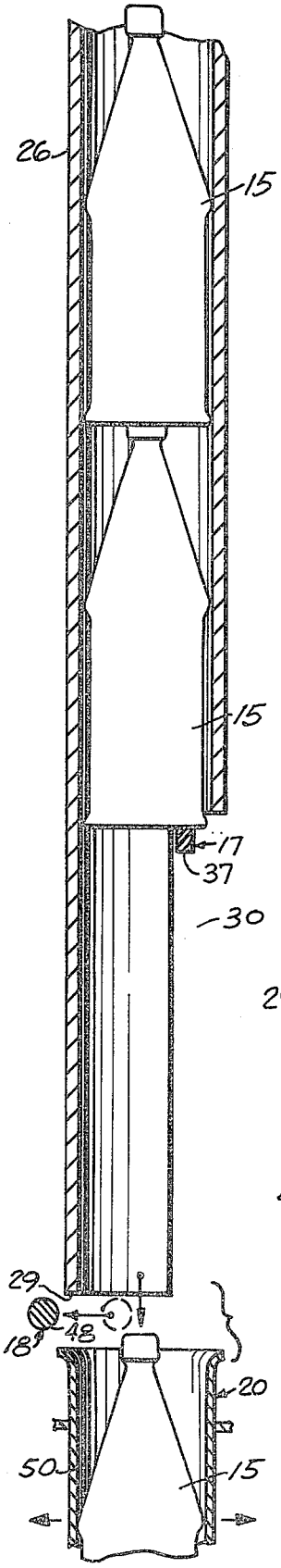
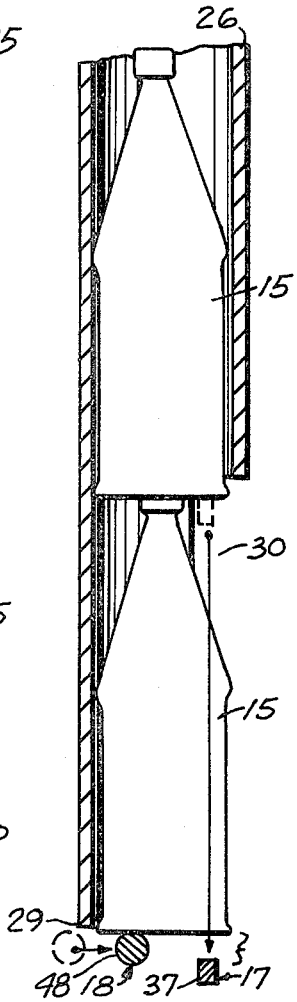
FIG. 7
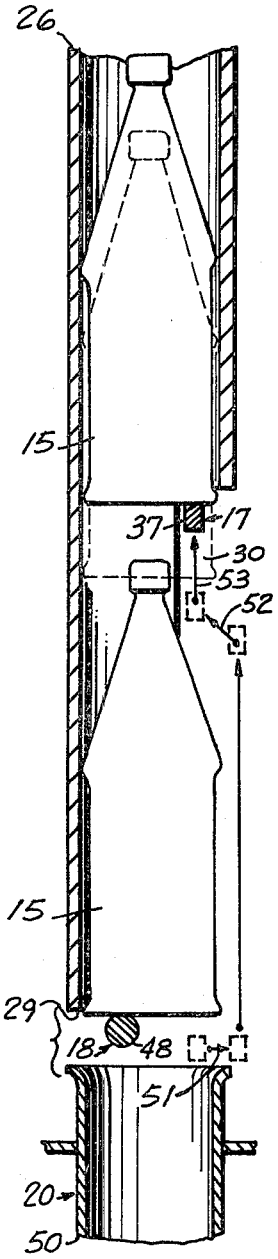
FIG. 8

ARTICLE ESCAPEMENT MECHANISM FOR CASE PACKING MACHINES

BACKGROUND OF THE INVENTION

The present invention is related to apparatus for separating successive groups of articles from an upright stack so they may drop gravitationally therefrom; and more particularly to such apparatus utilized for articles having reduced upper ends and enlarged lower ends and wherein the articles are arranged in an upright stack with the reduced ends of one set of articles nesting in the enlarged ends of the next successive group of articles.

Most bottles, cans and packages are placed in paperboard or cardboard containers for shipping. These cartons ae three-dimensional rectangular enclosures which have a top, bottom, two sides and two ends. Most cylindrical articles such as cans and bottles are placed upright in the cartons and in one or two layers with or without dividers positioned between the layers. The size, weight, and number of the articles generally determine the most economical arrangement and shape of the carton enclosure. Generally, articles are packed in multiples of six with 24 being the most popular size. A carton containing 24 articles is frequently referred to as a "case" and a carton containing 12 articles is generally referred to as a "half-case." This terminology is most commonly used in the beverage and canned goods industry. A case of 24 bottles or cans is generally arranged in a single layer of four files and six ranks. A "half-case" is generally arranged in three files with four cans or bottles in each, and four ranks with three cans or bottles each.

In loading the articles into the cases or cartons, a case packing machine is generally utilized to separate in successive groups the prescribed numbers of articles, usually 6, 12, or 24, from a stack. The machine then automatically places each group of articles within a case or container supplied by conveyor. Usually, the bottles or cans are forced horizontally into a container having a side opening. With the bottles or cans entering in a horizontal relationship, it follows that a substantial amount of floor space will be occupied by the article-handling mechanisms that feed rows of articles horizontally toward the waiting containers. It has therefor become desirable to re-orient the in-feed of bottles or cans so they will take up less floor space. This is done by arranging the entering rows of articles vertically.

Development of new plastic containers has caused some difficulty with the vertical feeding machines in that the ordinarily reliable escapement mechanisms utilized therewith do not handle the containers gently enough to prevent article damage.

An example of a previously preferred form of escapement mechanism is disclosed in United States Patent Application Ser. No. 458,106 filed Apr. 5, 1974, and commonly assigned with the present application. This device makes use of an escapement mechanism whereby the entire upright weight of an article stack is allowed to successively drop onto a stationary surface from a height equal or slightly greater than the overall height of a single article. Although this escapement mechanism is very effective, it can damage articles that are fragile by nature. The development of thinner plastic beverage containers has necessitated the replacement of the above described escapement mechanism with another by which the articles are handled more gently.

The present invention is concerned with an escapement mechanism by which vertically stacked articles may be successively released in prescribed groups without allowing the vertical stack to be abruptly dropped onto a stop mechanism. This is accomplished by providing a vertically moveable stop mechanism that engages successive groups of articles and gently lowers them along with the entire stack to a retractable support mechanism. The stop mechanism is further designed to return to a first elevation after delivering a group of articles to the retractable support mechanism so that the stack of articles may be gently lifted from engagement with the group of articles presently resting on the support mechanism. The only downward force on the retractable support is the weight of the group itself rather than the entire weight of the vertical stack of articles. With the remainder of the stack supported by the stop mechanism, the retractable support may be moved from under the group of articles to allow the articles to fall freely to a transfer mechanism.

SUMMARY OF THE INVENTION

An escapement mechanism is described for handling articles in successive groups. The articles each include a reduced upper end and an enlarged lower end and are initially stacked vertically one against another with the reduced upper end of one article engaged against the enlarged lower end of an adjacent article to form a plurality of upright columns. The effective heights of the articles are equal and the columns are arranged parallel to each other in a rectangular array to thereby form rectangular groups of articles within the hopper. The article groups are urged downward toward a hopper discharge end. The present escapement mechanism operates upon the articles as described above and is comprised of a vertically moveable stop means and a horizontally retractable support means that are mounted to a supportive framework adjacent the hopper discharge end. The stop means is utilized to alternately engage and support a group of articles at a first elevation and to release the articles at a downwardly spaced second elevation. A lift means is employed for vertically moving the stop means between the first and second elevations. The retractable support means is utilized for intersecting the columns of articles at one of the elevations in order to provide support therefor while the stop means is moved clear of the article columns. The retractable support means is also utilized to operate the successive groups of articles in response to operation of the stop means to alternately release and support successive groups of articles.

It is a primary object of the present invention to provide an escapement mechanism for articles whereby articles may be fed vertically into the escapement mechanism and released thereby in groups to a transfer means, the groups being dropped under their own weight separate from the remainder of the articles located above.

Another important object is to provide such a mechanism whereby the upright columns of articles are gently lowered as the successive groups are delivered from the escapement mechanism without the columns themselves being dropped intermittently toward the escapement mechanism.

Another object is to provide such an escapement mechanism that is relatively simple in construction, easy to operate, and maintain.

These and still further objects and advantages will become apparent upon reading the following detailed description which, taken with the accompanying drawings, disclose a preferred form of the present invention. It is well understood, however, that other embodiments may be envisioned that are not described within the following detailed description and which, in fact, do not depart from the scope of this invention. It is, therefore intended that only the claims found at the end of this specification are to be taken as definitions of the present invention.

BRIEF DESCRIPTION OF THE DRAWINGS

FIGS. 5–8 are operational schematic views.

DETAILED DESCRIPTION OF A PREFERRED EMBODIMENT

Figure 1:
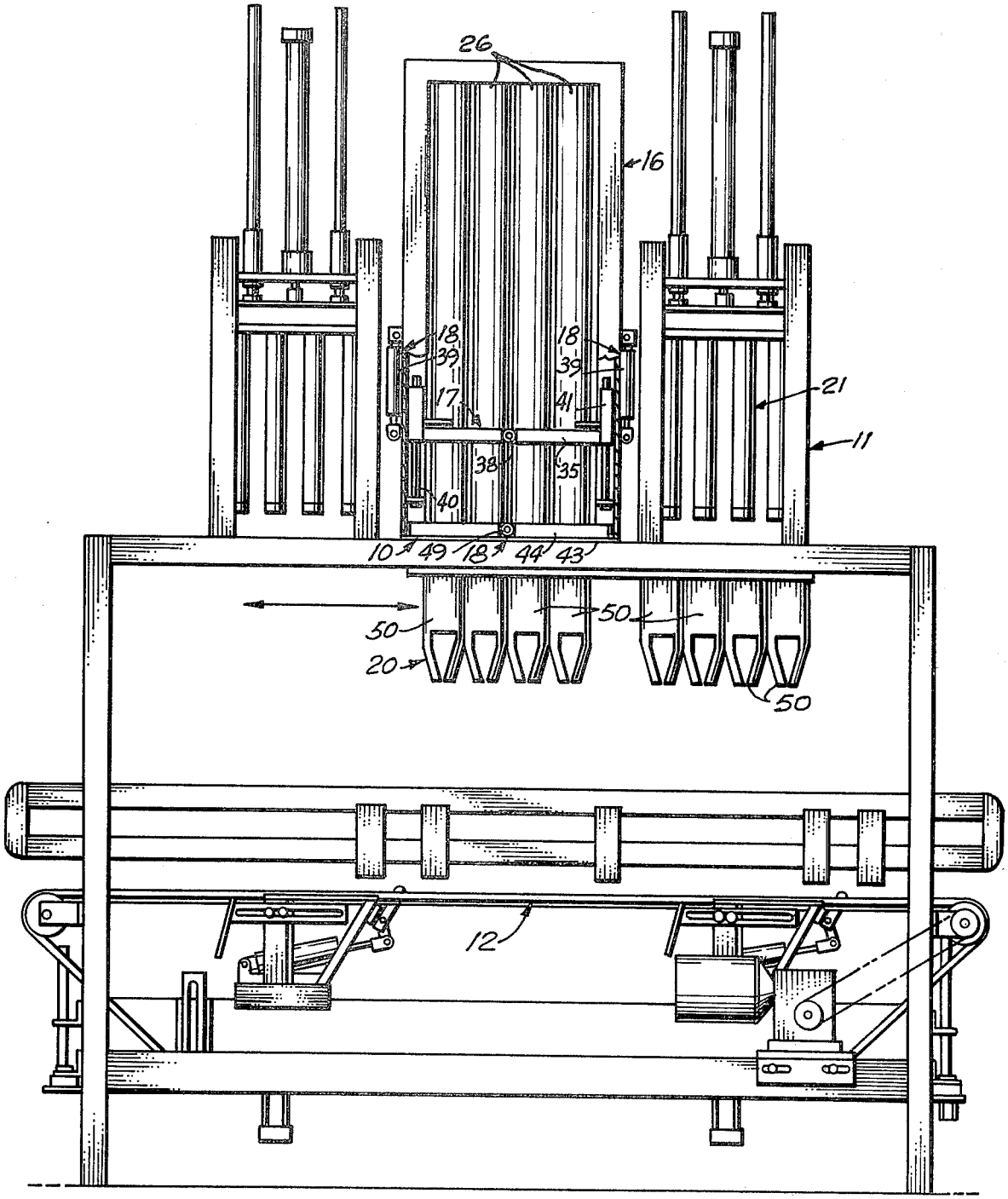
FIG. 1 is a front elevational view of the escapement mechanism shown in conjunction with a case-packing machine.

The apparatus of the present invention is illustrated in the accompanying drawings and is designated generally therein by the reference numeral 10. The present apparatus is shown in conjunction with a casepacking machine that is shown generally at 11. The case packer 11 positions individual empty cases (not shown) on a conveyor 12 to fill the cases with articles such as those shown schematically in FIG. 5–8 at 15. Typical types of articles to be utilized in conjunction with the present invention are bottles having reduced upper ends and enlarged lower ends so that when stacked together, the reduced upper end of one bottle nests against the enlarged lower end of an upwardly adjacent bottle.

Although it is not critical that the apparatus be used exclusively on bottles, it is important that the articles have reduced upper ends and enlarged lower ends as do the articles shown in FIG. 5–8. This configuration enables individual articles to be engaged along their bottom ends by elements of the present apparatus.

The present invention includes an upright hopper 16 that is designed to direct upright columns of nested articles downwardly toward a hopper discharge end. A stop means 17 is located adjacent to the hopper discharge for movement relative to the columns between a first and second elevation. Basically, the stop means 17 is utilized to engage successive groups of articles along their enlarged bottom surfaces and move them from a first elevation to a lower second elevation.

A retractable support means 18 is located adjacent the hopper discharge at the second elevation to alternately support and release individual groups of articles. Articles dropping from engagement by the retractable support 18 fall freely toward a transfer means 20. Transfer means 20 is utilized to shift the articles clear of the columns for loading into cartons by a loading mechanism 21 (FIG. 1).

Figure 2:
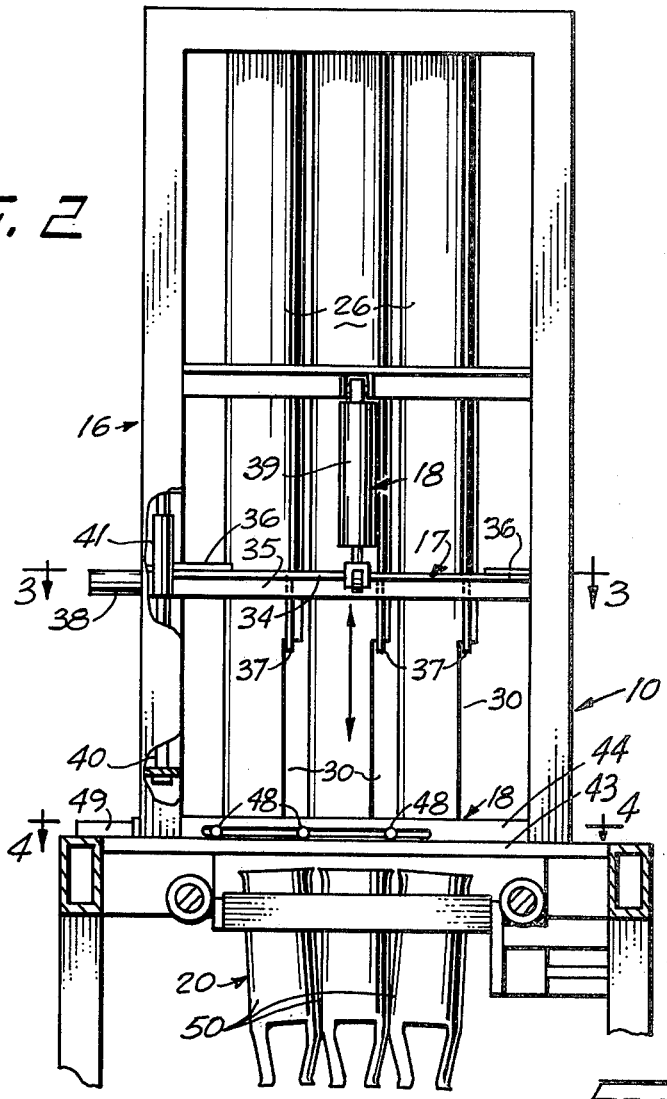
FIG. 2 is an enlarged fragmentary section view taken along line 2—2 in FIG. 1.

Referring now in greater detail to the specific elements of the present invention, reference will be made first to FIG. 2. In FIG. 2, the hopper 16 is shown as being comprised of a plurality of upright tubular guides 26. The tubular guides 26 are arranged in a rectangular pattern comprised of longitudinal files and transverse ranks. Each tubular guide 26 is designed to receive and guide downward movement of an upright stack of articles as partially shown in FIG. 5. For "half cases," twelve tubular guides are provided with four guides in each file and three guides included in each rank. It is well understood that a slightly modified form of the present invention may be utilized to operate upon greater or fewer numbers of articles per group than disclosed in the accompanying drawings.

Each tubular guide 26 includes, along one side thereof, a relief 30. The relief 30 is simply comprised of a cut away section to allow vertical and lateral movement of elements for the stop means 17. The reliefs 30 lead downwardly from closed top ends above a first elevation for the articles, to open discharge tube ends 29 that are coplanar with the hopper discharge.

Figure 3:
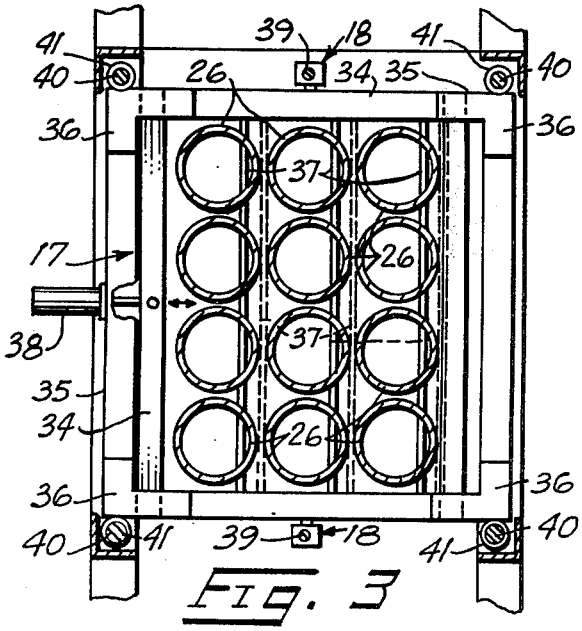
FIG. 3 is a section view taken along line 3—3 in FIG. 2.

The stop means 17 is illustrated in substantial detail by FIGS. 2 and 3. As shown, the stop means 17 is moveably mounted to the framework for mechanism 10 and includes a laterally slidable framework 34 and a vertically slidable framework 35. The laterally slidable framework 34 is mounted to the vertically slidable framework 35. Frame 34 slides freely laterally on framework 35 as directed by a number of horizontal guides 36. Stop bars 37, provided on frame 34, may thus be moved into and out of intersection with the article columns.

Stop bars 37 are illustrated in FIGS. 3 and 5–8. Each bar 37 extends along the full length of a respective file 28. Opposite ends of bars 37 are fixed to the laterally slidable frame 34. For clearance purposes, the bars 37 are located downwardly adjacent to the remainder of the frames 34 and 35. Alternate positions of the stop bars 37 are shown by solid and dashed lines in FIG. 3.

An operative position of stop bars 37 is shown in FIG. 3 by solid lines. This lateral position is also shown in FIGS. 5–8. In this position, the bars 37 intersect the individual columns to support the articles along a horizontal plane. The laterally slidable frame 34 is selectively moved between the positions (shown in FIG. 3 by solid and dashed lines) by a ram cylinder 38. Cylinder 38 is mounted between frameworks 34 and 35 to cause lateral movement of the stop bars 37 as indicated by the arrows in FIG. 3.

Lift means 18 is utilized to move the stop bars 37 between the differing elevational positions shown in FIGS. 5–8. Lift means 18 includes an opposed pair of vertical cylinders 39 (FIG. 1) that interconnect the case packer framework with the vertically slidabe framework 35. Operation of cylinders 39 serves to slide the framework 35 and thereby stop bars 37 a selected distance. Vertical movement of the bars is assured by upright guideposts 40 located at four corners of framework 35. Each corner of frame 35 includes thereon an upright slide bushing 41. Bushings 41 slidably engage the guideposts 40 to define a vertical path for the stop bars 37.

Stop means 17 and lift means 18 perform the function of delivering successive groups of articles downwardly to the retractable support 19.

Figure 4:
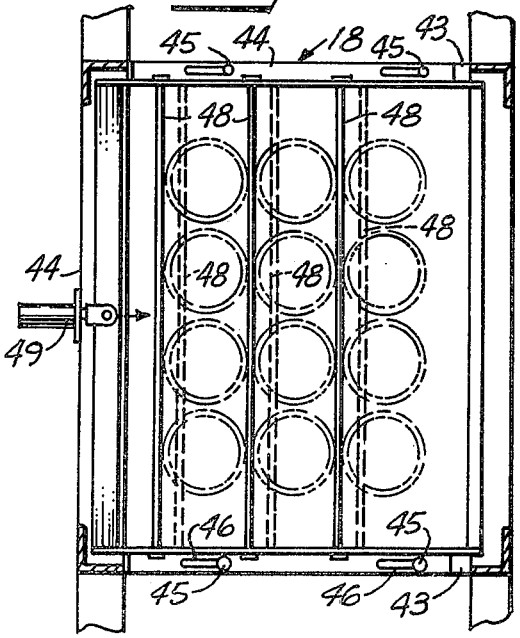
FIG. 4 is a section view taken along line 4—4 in FIG. 2.

Support 19 is shown in detail by FIGS. 2 and 4. Basically, the retractable support means 19 includes a stationary support frame 43 and a horizontally slidable frame 44. Slidable frame 44 is mounted for sliding translational movement in a fixed horizontal plane.

Frame 44 is slidably mounted to frame 43 through pins 45 extending from frame 44 through guide slots 46 formed through frame 43.

A number of escapement rods 48 are mounted to slide frame 44 in parallel relation to the files of articles 15. There is one escapement rod for each file of articles. The rods are movable along with frame 44 between positions intersecting the article columns and positions clear of the article columns. These positions are shown in FIG. 4 by dashed and solid lines respectively. A ram cylinder 49 interconnects the slide frame 44 and support frame 43 to impart the horizontal translational movement of rods 48 in response to operation of stop means 17.

Articles are dropped as the rods 48 are moved by ram 49 to inoperative positions clear of the columns. These released articles are then free to fall toward an article transfer means 20.

The article transfer means 20 may take the form of article receiving chutes or "cans" 50 on a laterally moveable carriage as shown in FIGS. 1 and 2. Transfer means 20 may also exist as any appropriate apparatus for moving the released groups of articles clear of the hopper discharge and upright columns of articles. The illustrated transfer means 20 is substantially identical to a transfer means described in United States Patent Application Ser. No. 458,106 filed Apr. 5, 1974, and commonly assigned with the present application. Portions of that application dealing with the transfer means are hereby incorporated by reference into the present application.

Operation of the present invention may be easily understood with reference to FIGS. 5–8 of the accommpanying drawings. When the machine is at rest, the stop means 17 and retractable support means 18 are situated in inoperative positions with rods 48 and bars 37 engaged along the bottoms of two successive adjacent article groups (FIG. 5). The bottoms of articles 15 supported by bars 37 are located in a horizontal plane at the first elevation. The bottoms of articles supported on escapement rods 48 are located along a horizontal plane at a second elevation.

An operational cycle is initiated as the ram cylinder 49 is actuated to pull the rods 4 laterally clear of the article columns. This movement is illustrated by FIG. 6. The rods 48 move from engagement with the article bottoms and therefore allow the articles to fall downwardly into the transfer means 20 presently locted below. The remainder of the article columns are supported by stop bars 37 at the first elevation.

After a short delay, the lift means 18 is actuated to lower stop bars 37 toward the hopper discharge end. This movement results in corresponding downward movement of the entire article columns. It is important that this movement be gradual since the weight of an entire column of articles is resting upon the bottom article of each column.

Before the stop bars 37 reach the second elevation, ram cylinder 49 is actuated to move the escapement rods 48 back to an operative position to receive and support the next successive groups of articles. Continued downward movement of the stop bars 37 brings the next successive group of articles into engagement with the escapement rods 48 as shown in FIG. 7. The stop bars 37, however, move on downwardly slightly beyond the second elevation. This is done so the stop bars 37 may be moved laterally clear of the article columns without rubbing across the article bottoms.

As the stop bars 37 reach the lower limit of their downward movement, the cylinder 38 is actuated to move the stop bars 37 laterally clear of the article columns. This movement is illustrated by arrow 51 in FIG. 8.

When bars 37 move clear of the article columns, the lift means 18 is again actuated to move the stop bars 37 vertically for engagement with the next successive group of articles. Before the stop bars reach the first elevation, cylinder 38 is again actuated to move the bars 37 into positions intersecting the article columns. The combined lateral and vertical motion components of bars 37 result in angular upward movement of stop bars 37 as indicated by arrow 52 in FIG. 8.

It is intended that stop bars 37 reach fully inward positions intersecting the article columns before they engage the bottoms of the next successive article group. The rods will then continue to move vertically once they reach the operative column intersecting positions as shown by arrow 53 in FIG. 8. Thus the rods will engage the articles directly and will not slide laterally against the article bottoms.

Prior to reaching the first elevation, the bars 37 engage the lower ends of the next successive article group and lift them upwardly from engagement with the reduced ends of the group presently resting on escapement rods 48. The articles are moved from the dashed-line position at the top of FIG. 8. This removes the weight of the article columns from the articles resting on rods 48 and permits free movement of the rods without resistance due to the weight of the article columns. Once the group of articles has been raised to the first elevation, the operational cycle is complete.

It is understood that placement of the escapement mechanism (rods 48 and bars 37) may be varied somewhat without departing from the scope of this invention. For example, instead of locating the escapement rods 48 at the second elevation, it would be entirely possible to relocate these rods at the first elevation. These rods could then hold the article columns at the first elevation while the stop bars 37 move a group of articles downwardly to the first elevation and then slide laterally clear of the articles to allow them to drop into the transfer means 20 below.

Operation of the transfer means is described in some detail in the application as referenced above. During such operation, the transfer means is utilized to receive articles at the hopper discharge and move the articles laterally clear of the articles columns. Once moved to this position, the articles are forced out through the transfer means and into a waiting box by a case-loading means 21. This feature is also discussed in the reference application.

It is understood that various changes and modifications, in addition to those discussed above, may be envisioned from the teaching of the above disclosure. The disclosure is not intended to place restrictions upon the scope of this invention, but rather to describe a preferred form thereof. Therefore, only the following claims are to be taken as definitions and restrictions upon the scope of the present invention.

What is claimed is:

1. An escapement mechanism for handling articles in successive groups wherein the articles each include a reduces upper end and an enlarged lower end and are initially stacked vertically one against the other with the reduced upper end of one article engaged against the enlarged lower end of an adjacent article to form a plurality of upright columns, the effective heights of said articles being equal, and said columns being arranged parallel to each other and in a rectangular array to form rectangular groups of articles within a hopper with the article groups being urged downward toward a hopper discharge end; said escapement mechanism comprising:

a supportive framework;

stop means adjacent the hopper discharge for alternatively engaging and supporting a group of articles at a first elevation and releasing the articles at a downwardly spaced second elevation;

wherein the stop means includes (a) a laterally movable framework movably mounted to the supportive framework, (b) a number of stop bars equal to the number of article files mounted to the movable framework and extending along the length of the files, and (c) means for laterally moving the stop bars between positions intersecting the article columns and positions laterally clear of the article columns;

lift means for vertically moving the stop means between the first and second elevations; and retractable support means for intersecting the columns of articles at one of the elevations to provide support therefore while the stop means is moved clear of the article columns and for moving clear of the columns to release a group of articles at the one elevation as the stop means is moved to intersect the columns and provide support therefore.

2. The escapement mechanism as recited by claim 1 wherein the laterally movable framework is mounted on a vertically slidable carriage and wherein the lift means includes a lift ram means interconnecting the framework with the vertically slidable carriage for moving the stop bars vertically between the first and second elevations.

3. The escapement mechanism as recited in claim 1 wherein the vertica distance between the first and second elevations is at least equal to the effective height of the articles.

4. The escapement mechanism as recited by claim 1 wherein the lift means is operated to move the stop means so it will separate a group of articles vertically from the remainder of the columns supported by the retractable support means before the retractable support means is operated to release the group of articles.

5. The escapement mechanism as recited by claim 1 wherein the means for laterally moving the stop bars is operated to move the stop bars laterally into positions intersecting the article columns before the bars reach the first elevation.

6. The escapement mechanism as recited by claim 1 wherein the retractable support means is comprised of:

a laterally movable escapement framework mounted to the supportive framework;

escapement rods on the laterally movable escapement framework extending the length of the article files with one escapement rod for each file; and ram means for laterally moving the escapement rods between positions intersecting the article columns and positions clear of the article columns.

7. The escapement mechansim as recited by claim 1 wherein the retractable support means operates in a plane adjacent the first elevation.

8. The escapement mechanism as recited by claim 1 wherein the retractable support means operates in a plane at the second elevation.

* * * * *